United States Patent [19]

Mainot et al.

[11] 4,341,169

[45] Jul. 27, 1982

[54] MACHINES FOR MAKING WELTED OPENINGS IN A PIECE OF MATERIAL OR SIMILAR

[75] Inventors: Jean-Louis Mainot; Alain Picaud, both of Paris, France

[73] Assignee: The Reece Corporation, Waltham, Mass.

[21] Appl. No.: 188,132

[22] Filed: Sep. 17, 1980

Related U.S. Application Data

[63] Continuation of Ser. No. 970,992, Dec. 19, 1978, abandoned.

[30] Foreign Application Priority Data

Dec. 21, 1977 [FR] France ..... 77 38702

[51] Int. Cl.[3] ..... D05B 21/00; D05B 3/10

[52] U.S. Cl. ..... 112/121.12; 112/68

[58] Field of Search ..... 112/121.12, 121.11, 112/65, 68, 70, 264.1, 122, 123 R, 129, 44, 52

[56] References Cited

U.S. PATENT DOCUMENTS

| | | | |
|---|---|---|---|
| 3,074,632 | 1/1963 | Braun et al. | 112/121.11 X |
| 3,653,345 | 4/1972 | Bianchi | 112/121.11 X |
| 3,763,802 | 10/1973 | Champney et al. | 112/121.12 |
| 3,814,037 | 6/1974 | Nicolay | 112/68 |
| 4,100,865 | 7/1978 | Landau, Jr. et al. | 112/121.11 |

*Primary Examiner*—Peter P. Nerbun

[57] ABSTRACT

A machine for making welted openings in a piece of material or similar, comprises control means arranged so as to cause it to make, in a pre-established sequence and cyclically, a succession of welted openings having different lengths requiring respectively single and indentical manual actions for starting up. The control means comprise:

- input means for feeding in initially and in the pre-established sequence information concerning the lengths of the different welted openings to be made,
- memory means for memorizing the set of length data fed in,
- selection means combined with the memory means so as to select successively in the pre-established sequence the lengths of the welted openings to be made,
- and monitoring means under the control of the selection means for, once the machine has been started up, checking the movement of cutting, stitching and notching members with respect to the selected length.

13 Claims, 2 Drawing Figures

MACHINES FOR MAKING WELTED OPENINGS IN A PIECE OF MATERIAL OR SIMILAR

Figure 1:
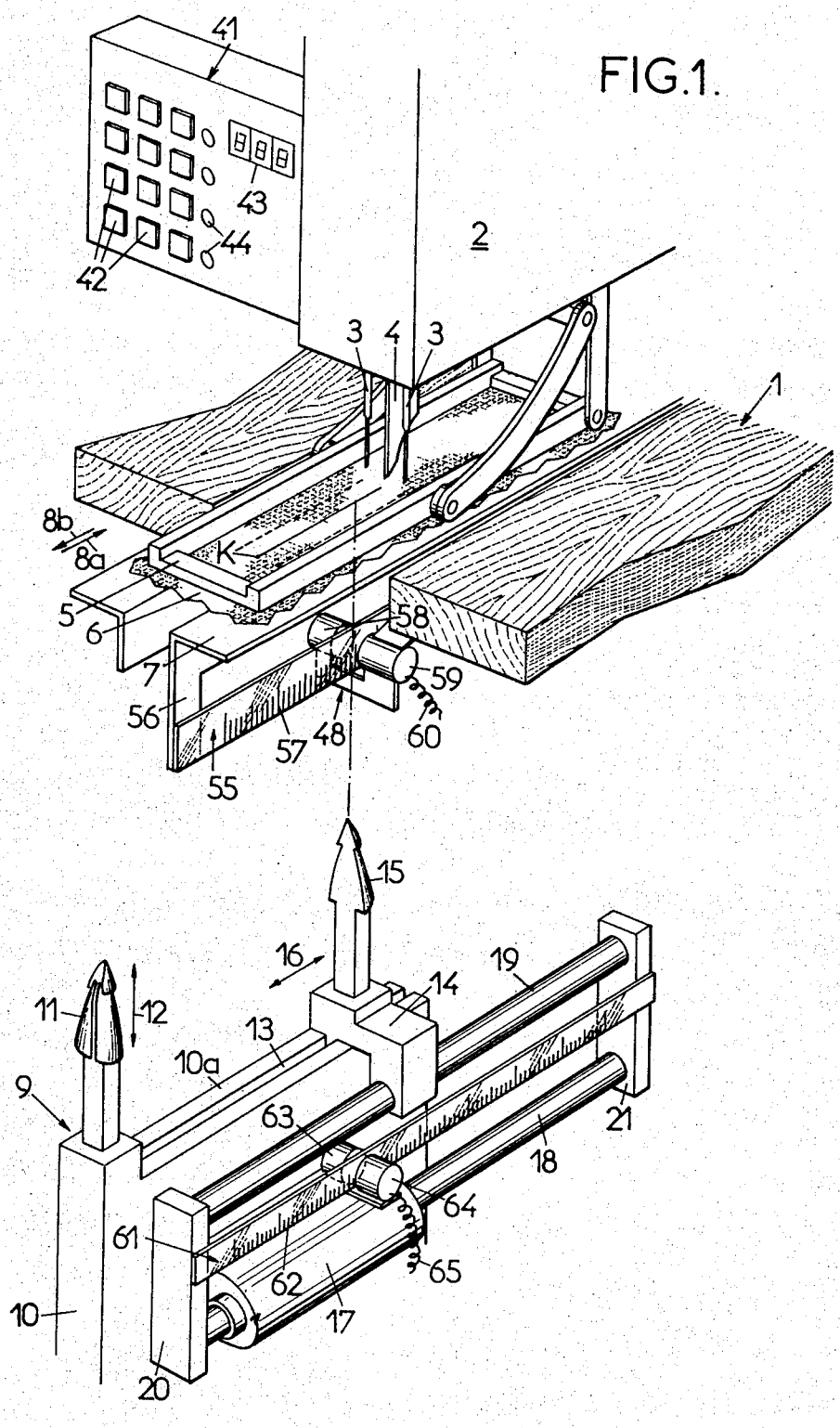

This is a continuation of Ser. No. 970,992, filed Dec. 19, 1978 now abandoned.

The present invention relates to improvements to machines for making welted openings, such as pocket openings, in a piece of material or similar.

In machines of this kind existing at present, the adjustment of the mechanism for making welted openings of a given length is done manually by moving a slider. As this adjustment mechanism is disposed inside the machine, the operator is forced to lift up the face plate of the machine then, by means of a screwdriver, loosen the locking member of the slider, position the slider in the desired position then re-tighten the locking member.

It will moreover be noted that the liftable face-plate supports, on its upper face, the sewing machine properly speaking and, on its lower face turned towards the inside of the machine, a number of control mechanisms for the sewing machine, mechanisms for feeding the piece of material and mechanisms for cutting and noching the openings made in the piece of material. The result is that the weight of this face plate is fairly high.

For this reason, in addition to the above-mentioned adjustment being relatively long to effect, the raising of the face-plate requires a physical effort all the greater that the personnel assigned to the operation of this kind of machine is, for the most part, feminine personnel.

Furthermore, during the manufacture of clothes having several pockets of different lengths (for example, wallet pockets, pen pocket, lighter pocket inside a jacket), it is necessary to handle the pieces of material three times which entails making in series the pockets of a first length for all the pieces of material, then the pockets of a second length, then the pockets of a third length, modifying the adjustment of the machine between series.

It is then only when all the pieces of material of a pile have been treated that they can be fed towards the next manufacturing station.

The result is uneveness in the feeding of the different work stations.

The invention has essentially as its object to remedy the disadvantages of the existing machines and to make them answer better than heretofore the different requirements of practice. To this end, the machine of the invention is characterized by the fact that it comprises control means arranged so as to cause it to make, in a pre-established sequence and cyclically, a succession of welted openings having different lengths, through a succession of single and identical manual actions for starting up.

It is thus possible to treat in one go the same piece of material and to make therein successively the different welted openings with which it is to be provided, the machine adjusting itself automatically to the appropriate length.

According to one preferred embodiment of the invention, the control means comprise:

- input means for feeding in initially and in the pre-established sequence information concerning the lengths of the different welted openings to be made,
- memory means for memorizing the set of length information fed in,

- selection means combined with the memory means so as to select successively in the pre-established sequence the lengths of the welted openings to be made,
- and monitoring means under the control of the selection means for, once the machine is operating, monitoring the length of movement of cutting, stitching and notching members, with respect to the selected length.

It is advantageous to provide the input means in the form of a keyboard and, for monitoring the sequential and cyclic operation of the machine, to provide display means for displaying the length of the opening selected by the selection means and/or the order number, in the sequence carried out, of the opening corresponding to the given length.

In this case, the keyboard and the display means are preferably arranged in a common casing, accessible from outside the machine.

The operator is thus able to adjust the machine and to supervise the operation thereof without being forced to raise the face-plate.

Moreover, it is advantageous for the monitoring means to comprise:

- first monitoring means for monitoring the length of the movement of the piece of material under the cutting and stitching members,
- and second monitoring means for monitoring the position of that one of the two notching fingers which is movable.

Preferably, the first and second monitoring means each comprise a sensor means for sensing the instantaneous position of a mobile element subjected to the movement to be monitored, comparator means for comparing said instantaneous position with the predetermined length selected by the selection means and stop control means for stopping the movement in progress when the length travelled by the mobile element is equal to said selected length.

According to a particularly simple arrangement, the sensor means comprises a transparent mobile rule provided with opaque graduations and a radiation transmitter and receiver fixedly disposed on each side of the graduated rule.

In this case, the transparent rule of the sensor means included in the first monitor means may be provided integral with a mobile table for feeding the piece of material and the transparent rule of the sensor means included in the second monitor means may be provided integral with a cylinder for driving the support of the mobile notching finger.

Furthermore, counting means are provided for counting the pulses delivered by the radiation receiver when the graduations of the rule intercept the radiation, the radiation used being preferably infra-red radiation to make the monitor means insensitive to the surrounding lighting.

Figure 2:
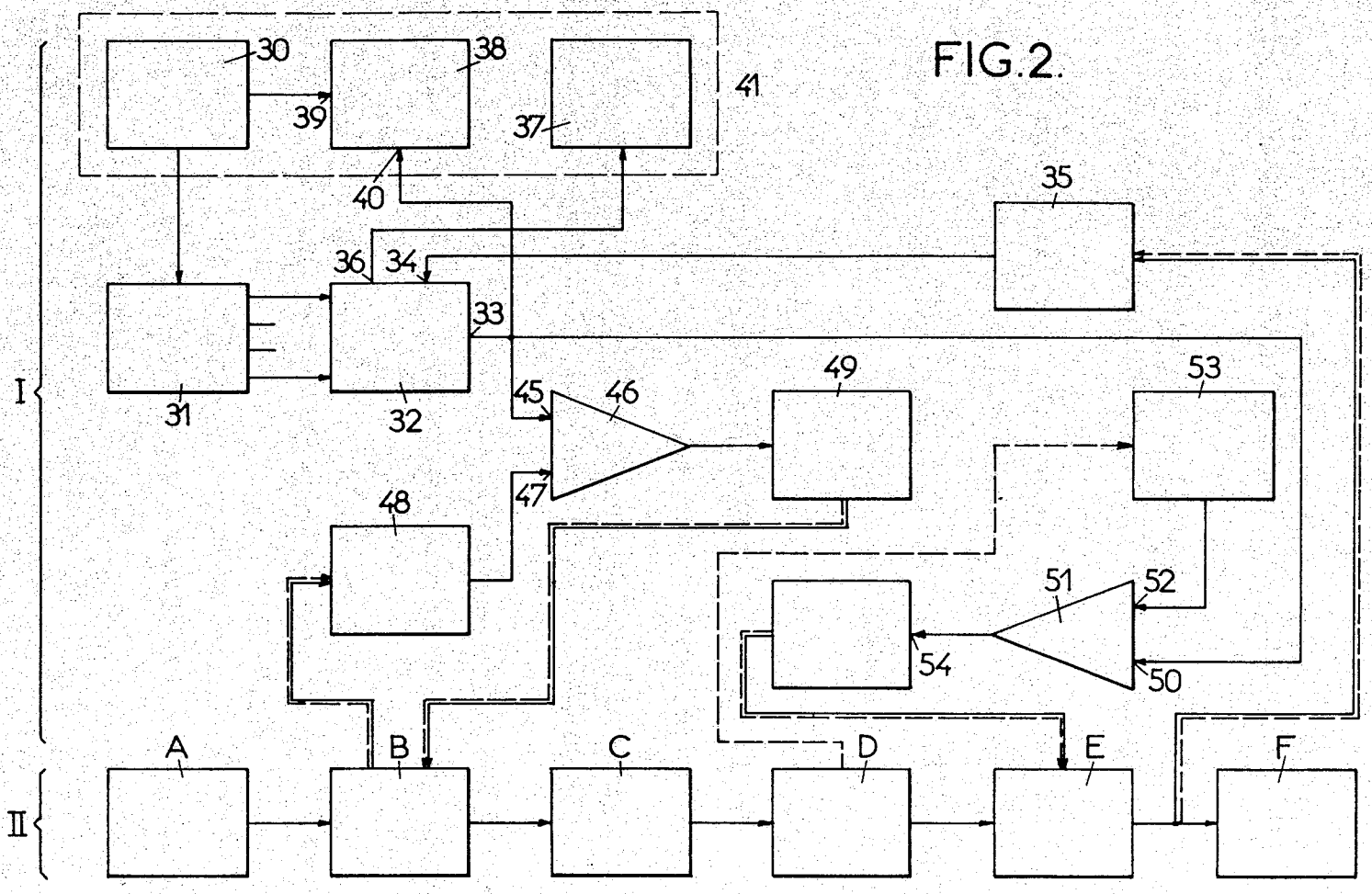

The invention will be better understood with the help of the description which follows of a preferred embodiment, given by way of illustrative but in no wise limitative example: in this description reference is made to the accompanying drawings in which:

FIG. 1 is a fragmentary perspective view, exploded with parts cut away, of a machine according to the invention; and FIG. 2 is a block diagram showing the control of the machine of FIG. 1.

First, the essential parts of a machine of the type concerned by the invention will be described.

As shown in FIG. 1, the machine comprises a face-plate 1, liftable by rotation about a hinge (not visible in the FIG.) situated along its rear side, on which rests a sewing-machine 2. This latter, for making double welted openings, is provided with two needles 3, spaced transversely from one another, for stitching the edges of the welted opening (e.g. a pocket opening of a piece of clothing) and a cutting blade 4 disposed between the two needles and substantially equidistant therefrom for cutting in the material the pocket opening.

A mobile clamping frame 5 maintains the piece of material 6 firmly applied and stretched on a mobile table 7 movable longitudinally in relation to face-plate 1, as shown by the double arrow 8.

The machine also comprises, under face-plate 1, a notching mechanism 9 for cutting in V form the two ends of the pocket opening after cutting out and stitching thereof, and for turning the material back. This mechanism 9 comprises essentially a fixed support 10 carrying, at its end the closest to the front of the machine, a first notching finger 11 vertically movable as shown by the double arrow 12. Support 10 comprises a portion 10*a*, elongated substantially parallel to face-plate 1, grooved longitudinally to form a guide slide 13 for a moving carriage 14 supporting a second notching finger 15, vertically movable as shown by the double arrow 12 in the same way as finger 11 and simultaneously therewith.

The movement of carriage 14 along portion 10*a* of support 10, as shown by the double arrow 16, is controlled by a double acting cylinder 17 fixed to support 10. For this purpose rod 18 of cylinder 17—which is disposed parallel to the elongated part 10*a* to reduce the space taken up by the mechanism—is connected to a rod 19, which is parallel thereto and which is integral with carriage 14, by means of two stays 20,21.

The different parts which have been described above, as well as some at least of their control devices are supported by face-plate 1.

There is however no need to describe the machine in more detail, its other parts and control mechanisms being known to the man skilled in the art.

In accordance with the invention, the machine is fitted with control means arranged so as to cause it to make, in a pre-established sequence and cyclically, a succession of welted openings having different lengths requiring respectively a succession of single and identical manual actions for starting up.

In FIG. 2, I designates the above-mentioned control means and II the operations effected by the machine.

The construction of the control means of the machine will now be described.

Reference 30 designates input means for initially feeding in, and in the pre-established sequence for making welted openings, information concerning the lengths of the different openings to be made.

A first output of the input means 30 is connected to the input of memory means 31 memorizing, in the order of the pre-established sequence, the set of length information.

Memory means 31 comprise a plurality of outputs, one output per length information, connected to corresponding inputs of a selection device 32 arranged to select and to deliver at its main output 33, successively in the pre-established sequence the lengths of the welted openings to be made.

Selection device 32 has moreover an auxiliary control input 34 connected to the output of a control circuit 35 controlling the switchover to the following length when the machine reaches the end of the cycle for making an opening.

It will be noted that the selection device 32 is arranged to select, under the control of circuit 35, the first length fed into memory means 31 once the welted opening having the last length fed into the memory means has been finished.

Finally, selection device 32 has an auxiliary output 36 at which appears information representative of the order number, in the pre-established sequence, of the length selected by the selection device. This output 36 is connected to the input of an auxiliary display means 37 for displaying said information and allowing the operator to supervise the proper progress of the pre-established sequence.

Moreover, and still to facilitate supervision of the machine, it is advantageous for the length information to be clearly visible either initially at the moment when it is fed into the memory means by the input means 30, or during operation of the machine to indicate the length selected by selection means 32.

To this end, a main display device 38 is provided, having a digital display, with two inputs one of which 39 is connected to an auxiliary output of input means 30 and the other of which 40 is connected to the main output 33 of selection means 32.

Input means 30, main display device 38 and the auxiliary display device 37 are arranged in a common casing 41, disposed on the machine, (e.g. on sewing machine 2 or on face plate 1) so that the operator has it permanently within reach and before his eyes.

As can be seen in FIG. 2, input means 30 comprise a keyboard 42 of the kind fitted to pocket calculating machines: as previously indicated, the main display device comprises a digital display 43 of the electroluminescent diode, bar or liquid crystal kind, this display being able to display with three figures (units, tens, hundreds) the actual value of the length expressed in metric units, or in any units as will be explained further on; finally auxiliary device 37 may simply comprise as many tell-tale lamps (formed preferably by electroluminescent diodes) as there are memory positions, and so different opening lengths achievable with the machine; by way of example, four tell-tale lamps corresponding to four types of opening have been shown in FIG. 1.

It will be noted that selection device 32 and the auxiliary display device are arranged so that the tell-tale lamps 44 light up successively one after the other, e.g. from top to bottom in FIG. 1, when the machine is making successively the welted openings in the pre-established sequence, the length of the corresponding opening being read on the display 43.

Furthermore, it will be noted that display 43 and tell-tale lamp 44 which is lit give an indication of the welted opening being made, when the machine is in operation, or else the opening which will be made when the machine is stopped, as will be explained further on.

Moreover, although it has not been shown so as not to over-load FIG. 2, control circuit 35 and selection device 32 are arranged so that, when length information is fed into memory means 31, selection device 32 selects necessarily the first information memorized when the machine is started up for making the first opening to be realized.

Main output 33 of selection device 32 is connected to a first input 45 of a first comparator element 46 whose second input 47 is connected to the output of a device 48 for measuring the instantaneous position of table 7 (see FIG. 1) supporting the material (one embodiment of the measuring device 48 will be given further on). The output of comparator element 46 is connected to the input of a device 49 for stopping the stitching and cutting of the opening and for stopping the forward movement of table 7.

Output 33 of selection device 32 is also connected to a first input 50 of a second comparator element 51, whose other input 52 is connected to the output of a device 53 for measuring the instantaneous position of the second notching finger 15 (FIG. 1). One embodiment of the measuring device will be given further on. The output of comparator 51 is connected to the input of a circuit 54 for controlling the vertical movement of the notching fingers 11 and 15 according to arrow 12 (see FIG. 1).

Referring again to FIG. 1, device 48 for measuring the instantaneous position of table 8 comprises a transparent or translucent rule 55, disposed parallel to the direction of movement, shown by double arrow 8, of table 7.

Rule 55 is rigidly fixed to table 7 to which it is fixed in any appropriate way: for example it is screwed on supports 56 themselves screwed to table 7. Moreover, rule 55 bears opaque marks 57. Preferably, these marks are evenly spaced from each other and may advantageously form a millimetric graduation.

On each side of rule 55 are disposed a radiation transmitter 58 and receiver 59, fixed to face plate 1 so that the radiation emitted by transmitter 58 reaches receiver 59 after passing through rule 55 (or else is intercepted by a mark 57 of the graduation).

Taking into account their particularly favourable reaction time and reliability, opto-electronic semi-conductor devices (electroluminescent diode and phototransistor) may advantageously be used to form transmitter 58 and receiver 59. To avoid the disturbing action of the surrounding lighting it is however preferable for these device to operate in the infra-red.

Receiver 59 forms an integral part of, or is connected by a wire 60 to, a counting circuit (not shown) for counting the electrical pulses transmitted by receiver 59 when the infra-red beam emitted by transmitter 58 is intercepted by a mark 57 of the graduation on rule 55.

Device 53 for measuring the instantaneous position of the second notching finger 15 is formed substantially in the same way as device 48 which has just been described.

For this reason, it comprises a transparent or translucent rule 61 firmly fixed to carriage 41 carrying finger 15; as shown, rule 61 is screwed on to the two stays 20 and 21.

Like rule 55, rule 61 is provided with opaque marks 62 forming a millimetric graduation. A transmitter 63 and a receiver 64, fixed for example to cylinder 17, are disposed on each side of rule 61 and the output of receiver 64 is connected (by a wire 65) to a pulse counting circuit (not shown).

The operation of the machine will now be described with reference to FIG. 1 and FIG. 2 in which the essential operations effected by the main parts of the machine are shown by the letters A to F.

Before anything else, the operator begins by reading in, with keys 42 of casing 41, the different lengths of the welted openings to be made in each piece of material. As previously indicated, each length tapped on the keyboard in the unit system chosen (in millimeters in the case considered) is displayed by display 43.

Now, the machine is ready to make, in the pre-established sequence and cyclically the envisaged succession of welted openings having respectively the different lengths fed into the memory.

The operator then disposes the piece of material 6 on table 7 so that the point K of the material (starting point for the opening to be made) is straight above notching finger 11.

The operator then starts up the machine (phase A in FIG. 2) by pressing for example the ON button (not shown in FIG. 1), the only manual action which he will have to make during the making of the opening considered.

Selection device 32 then selects the first length information present in memory means 31 which is then applied to input 45 of comparator element 46 and to input 50 of comparator element 51 and displayed on display 43 at the same time as the first tell-tale lights up, which thus shows that it is the first welted opening of the sequence which will be made.

After clamping frame 5 has come down on the material, table 7 moves back, as shown by arrow 8*a*, to bring said point K under cutting blade 4; then the table moves in the reverse direction (arrow 8*b*) at the same time as the operation begins for cutting and stitching the opening (phase B in FIG. 2).

During movement of table 7 in the direction shown by arrow 8*b*, graduated rule 55 which is firmly fixed thereto travels past the optoelectronic sensor 58,59 which delivers a pulse each time that a mark 57 intercepts the infra-red radiation.

The information formed by these pulses is continuously compared by comparator element 56 with the information supplied by selection device 32 and, when the movement made by table 7 reaches the desired value, comparator element 46 delivers an output signal actuating device 49 controlling the stopping of table 7.

Following which, the table is returned to its original position (phase C in FIG. 2) in which starting point K of the opening is situated above notching finger 11.

Then the carriage 14 of the notching mechanism is moved by cylinder 17 so that the mobile finger is moved away from finger 11 a distance corresponding to the length of the opening made in the material.

For this, during the movement of carriage 14, graduated rule 61 which is firmly fixed thereto travels past the opto-electronic sensor 64 which delivers a pulse each time that a mark 62 intercepts the infra-red ray.

The information formed by these pulses is continuously compared by comparator element 51 with the information present at input 52 thereof and supplied by selection device 32. When finger 15 has reached the desired position, comparator element delivers an output signal actuating device 54 controlling the actuation of the notching mechanism.

Once this operation has been carried out (phase E in FIG. 2), finger 15 is returned to its original position, frame 5 clamping the material on table 7 is raised and circuit 35 controls selection device 32 so that it selects the next memorized length corresponding to the next opening to be made. After which the machine stops (phase F in FIG. 2).

It may be noted that from this moment on the operator is informed by display 43 and by the second tell-tale 44 which has lit up, of the length and the order number in the sequence of the opening which the machine is ready to make.

The operator moves the piece of material, already provided with the first welted opening which has just been made, to position it on table 7 for making the second programmed opening, then he starts up the machine again by pressing the ON button which causes the operational process which has just been described to be repeated.

When all the programmed welted openings have been made in the same piece of material, selection device 32 again selects, as previously indicated, the first length information memorized, and the making cycle is repeated for a new piece of material, and this whatever the number of pieces of material to be treated and the number of welted openings to be made in each of them.

In this way, the operator can work continuously on each piece of material, which may be immediately afterwards fed to the next work station.

Furthermore, the programming of the machine is simple, rapid and does not require lifting of face-plate 1 and so is without physical effort.

To improve the operational safety of the machine and to forestall operating errors by the operator, particularly in so far as the feeding in of the length information by means of the key-board is concerned, it is possible to provide safety means.

For example, to avoid the unintentional feeding in of length information by accidentally pressing the keys of the keyboard, it may be provided that the feeding of the information may only be carried out if one key, specially provided for this purpose, is pressed during the operation of the other keys.

Moreover, because the machine is designed only for making welted openings whose length is intermediate a minimum length and a maximum length, a safety system may be provided which does not allow the machine to be started up if the length information fed into memory means 31 and selected by selection device 32 is greater than said maximum length or less than said minimum length.

Finally, the machine may be fitted with monitoring means for checking that the different operational phases take place correctly and in the right order, these monitoring means being arranged to stop the machine in the case of an error, for example when the notching fingers 11,15 are not mounted to cut the ends of the opening or else when these fingers are mounted but have not come down again.

Of course other safety systems may be provided by the man skilled in the art with respect to particular requirements.

As is evident and as it follows already moreover from what has gone before, the invention is in no wise limited to those of its embodiments and modes of application which have been more especially considered; it embraces, on the contrary, all variations thereof.

We claim:

1. Apparatus for automatically regulating the operation of cutting, stitching and notching means of a sewing machine forming welted openings in pieces of material or the like comprising memory means, input means for feeding to said memory means sets of information for the control in a predetermined sequence of said cutting, stitching, and notching means relative to each of a plurality of desired welted openings of predetermined length, means for selecting a sequence of sets of information from said memory, monitoring means for sensing, during operation, the position of the cutting, stitching, and notching members and comparing the same with said selected set of information, and means responsive to said monitoring means for controlling the operation of said cutting, stitching and notching means, whereby said sewing machine may be caused to make, in a pre-established sequence, a succession of welted openings, each having selected lengths.

2. Apparatus for automatically regulating the operation of the cutting, stitching and notching means of a sewing machine for forming a welted opening in a piece of material or the like comprising memory means, input means for feeding to said memory means a set of information for the control in a predetermined sequence of said cutting, stitching, and notching means relative to a desired welted opening of predetermined length, means for selecting said set of information from said memory, monitoring means for sensing, during operation, the position of the cutting, stitching, and notching means and comparing the same with said selected set of information, and means responsive to said monitoring means for controlling the operation of said cutting, stitching and notching means, whereby said sewing machine may be caused to make, pre-determined welted openings.

3. Apparatus for automatically regulating the operation of the cutting, stitching and notching means of a sewing machine for forming welted openings in pieces of material or the like comprising memory means, input means for feeding to said memory means a plurality of sets of information for the control in a predetermined sequence of said cutting, stitching, and notching means relative to each of a plurality of desired welted openings of predetermined length, means for selecting at least one of said sets of information from said memory, monitoring means for sensing, during operation, the position of the cutting, stitching, and notching means and comparing the same with said selected set of information, and means responsive to said monitoring means for controlling the operating of said cutting, stitching and notching means, whereby said sewing machine may be caused to make, a predetermined welted opening.

4. The apparatus according to claim 1, 2, or 3, including means for automatically causing said selection means to cyclically repeat the sequence upon the completion of the welted opening corresponding to the last information in the selected set.

5. The apparatus according to claim 1, 2, or 3, including display means for indicating the length of the opening of the selected set.

6. The apparatus according to claim 1, 2, or 3, including means for displaying the order of the selected set in the sequence.

7. The apparatus according to claim 1, 2, or 3, wherein the monitoring means comprises first means for sensing the length of the movement of the piece of material under the cutting and stitching members, and second monitoring means for sensing the position of the notching means said first and second monitoring means each comprising sensor means for sensing the instantaneous position of the mobile element subjected to the movement to be monitored, comparator means for comparing the instantaneous position with the predetermined length selected by the selection means and stop control means for stopping the movement in progress when the length travelled by the mobile element is equal to said length.

8. The apparatus according to claim 7 wherein each of the sensor means comprise a transparent movable rule provided with opaque graduations and a radiation transmitter and receiver fixedly disposed on each side of the graduated rule.

9. The apparatus according to claim 8, wherein the transparent rule of the sensor means forming part of the first monitoring means is firmly fixed to a mobile table feeding the piece of material and the transparent rule of the sensor means forming part of the second monitoring means is firmly fixed to a cylinder for driving the support of the mobile notching finger.

10. The apparatus according to claim 8, wherein counting means are provided for counting pulses delivered by the radiation receiver when graduations of the rule intercept the radiation during the movement thereof.

11. The apparatus according to claim 8, wherein the radiation employed is infra-red.

12. In a sewing machine forming welted openings in a piece of material or the like having means for movably carrying the piece of material relative to the cutting and stitching means, and the notching means includes a pair of fingers, one of which is movable relative to the other, apparatus for automatically regulating the operation of the cutting, stitching and notching means, comprising memory means, input means for feeding to said memory means sets of information for the control of said cutting, stitching, and notching means relative to each of a plurality of desired welted openings of selected predetermined length, means for selecting at least one of said sets of information from said memory, first and second sensor means for sensing the instantaneous position of the carrier of said material and the movable notching finger respectively, comparator means for comparing the instantaneous position with the predetermined length of the selected set of information and means responsive to said comparison to arrest the movement of said carrier means and said movable finger respectively, when the length travelled is equal to the predetermined length.

13. The apparatus according to claim 12, wherein said selecting means includes means for selecting a predetermined sequence of sets of information and said apparatus includes means for sequential operation to form a plurality of welts in accordance with said sequence.

* * * * *